US006608443B1

(12) United States Patent
Bae

(10) Patent No.: US 6,608,443 B1
(45) Date of Patent: Aug. 19, 2003

(54) LIGHTING APPARATUS USING MICROWAVE ENERGY

(75) Inventor: Young-Jin Bae, Daegu (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 10/127,234

(22) Filed: Apr. 19, 2002

(30) Foreign Application Priority Data

Mar. 6, 2002 (KR) ..... 10-2002-0011965

(51) Int. Cl.[7] ..... H05B 41/16
(52) U.S. Cl. ..... 315/39; 315/248
(58) Field of Search ..... 315/248, 39, 39.51

(56) References Cited

U.S. PATENT DOCUMENTS 6,445,138 B1 * 9/2002 Barry et al. ..... 315/248

FOREIGN PATENT DOCUMENTS

WO WO/00/70651 11/2000

WO WO02/11181 A1 2/2002

OTHER PUBLICATIONS

Office Action issued by Swedish Patent Office on Jan. 17, 2003 in relation to Swedish Patent Application No. 0201149–2.

* cited by examiner

*Primary Examiner*—David Vu
(74) *Attorney, Agent, or Firm*—Ostrolenk, Faber, Gerb & Soffen, LLP

(57) ABSTRACT

In a lighting apparatus, a lighting apparatus using microwave energy includes a magnetron for generating microwave energy, a bulb for generating lights by the microwave energy, a wave guide for connecting the magnetron and the bulb and transmitting the microwave energy generated in the magnetron to the bulb, and a casing housing the magnetron and the wave guide inside and combining with the bulb, herein the casing housing the magnetron is tightly contacted to the exterior of the magnetron in order to emit heat generated in the magnetron.

14 Claims, 3 Drawing Sheets

LIGHTING APPARATUS USING MICROWAVE ENERGY

BACKGROUND OF THE INVENTION

1. Field of the Invention

The present invention relates to a lighting apparatus using microwave energy.

2. Description of the Prior Art

A lighting apparatus using microwave energy emits visible rays or ultraviolet rays by applying microwave energy to an electrodeless plasma lamp, it has longer life-span and shows better lighting efficiency than that of an incandescent lamp and a fluorescent lamp.

FIG. 1 is a longitudinal sectional view illustrating a lighting apparatus using microwave energy in accordance with the conventional art.

As depicted in FIG. 1, the conventional lighting apparatus using microwave energy includes a magnetron 2 installed inside a casing and generating microwave energy, a high voltage generator 3 boosting the voltage of utility AC power and supplying it to the magnetron 2, a wave guide 4 connected to an outlet of the magnetron 2 and transmitting microwave energy generated in the magnetron 2, a bulb 5 generating a light by using enclosed luminous materials in a plasma state by receiving the microwave energy transmitted through the wave guide 4, a resonator 6 covering the front portion of the bulb 5 in order to cut off the microwave energy and pass the light emitted from the bulb 5, a reflector 7 receiving the resonator 6 and focus-reflecting the light generated in the bulb 5 straightly, a dielectric mirror 8 installed inside the resonator 6 at the rear of the bulb 5 in order to pass the microwave energy and reflect the light, and a cooling fan assembly 9 placed at the side of the casing 1 and cooling the magnetron 2 and the high voltage generator 3.

The bulb 5 is constructed with a luminous unit 5*a* made of quartz and ceramic and having enclosed luminous materials in order to emit lights by being excited by microwave energy and an axial unit 5*b* combined with the luminous unit 5*a* by welding and extended toward inside the casing 1.

In addition, the bulb 5 cools high heat generated at the luminous unit 5*a* by being rotated according to a bulb motor 10.

In the meantime, in the conventional lighting apparatus using microwave energy, the magnetron 2 generates microwave energy according to a power apply, the microwave energy generated in the magnetron 2 excites the luminous unit 5*a* of the bulb 5 after passing the wave guide 4 and the resonator 6, and the luminous unit 5*a* generates lights. The lights generated in the luminous unit 5*a* are reflected by the reflector 7, accordingly a lighting function can be performed.

However, in the operation of the conventional lighting apparatus using microwave energy, lots of heat is generated at the magnetron 2, the wave guide 4 and the high voltage generator 3, etc., as depicted in FIG. 1, the magnetron, etc. are cooled by sucking external air into the casing 1 by using the cooling fan assembly 9.

However, because the lighting apparatus can be used at outdoors as well as indoors, in an air cooling type using a cooling fan in order to cool a heat generating unit of the lighting apparatus using microwave energy, impurities such as bugs, dusts, etc. or rain may come into, accordingly the apparatus may be damaged or a life-span of the apparatus may be lowered.

Particularly, if a quantity of a lighting apparatus is increased in order to improve a brightness, heat generated inside the apparatus has to be discharged more efficiently.

SUMMARY OF THE INVENTION

In order to solve the above-mentioned problems, it is an object of the present invention to provide a lighting apparatus using microwave energy which is capable of emitting heat generated inside the apparatus to outside more efficiently and having a sealed cooling structure preventable penetration of external impurities.

In order to achieve the above-mentioned object, a lighting apparatus using microwave energy includes a magnetron for generating microwave energy, a bulb for generating lights by the microwave energy, a wave guide for connecting the magnetron and the bulb and transmitting the microwave energy generated in the magnetron to the bulb and a casing housing the magnetron and the wave guide inside and combining with the bulb, herein the casing housing the magnetron is tightly contacted to the exterior of the magnetron in order to emit heat generated in the magnetron.

A lighting apparatus using microwave energy includes a magnetron for generating microwave energy, a bulb for generating lights by the microwave energy, a wave guide for connecting the magnetron and the bulb and transmitting the microwave energy generated in the magnetron to the bulb, and a casing housing the magnetron and the wave guide inside and combining with the bulb, herein the casing and the external surface of the magnetron are formed as one body in order to emit heat generated in the magnetron.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, a lighting apparatus using microwave energy in accordance with the present invention will be described in detail with reference to accompanying drawings.

Figure 1:
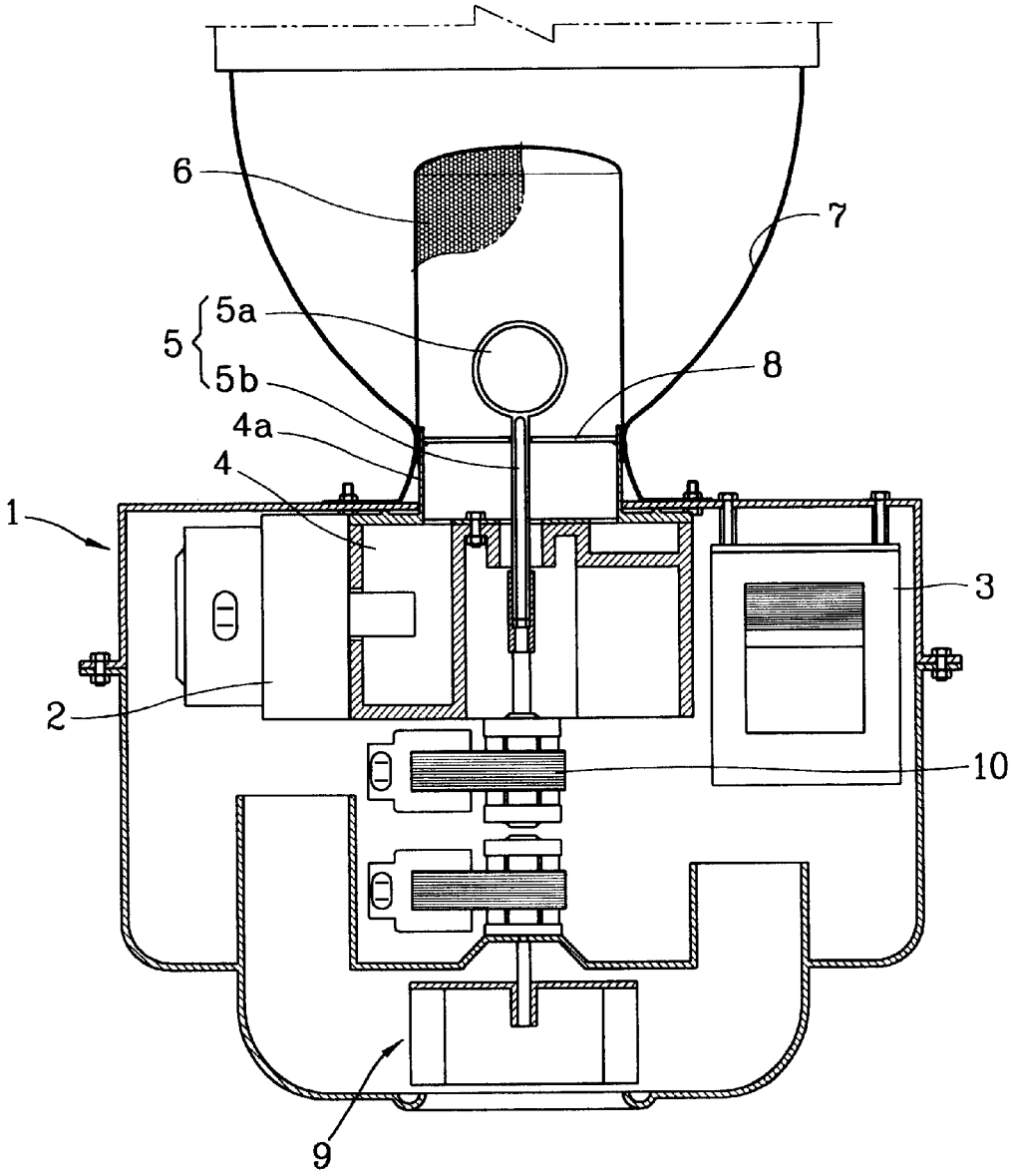
FIG. 1 BACKGROUND ART
FIG. 1 is a longitudinal sectional view illustrating a lighting apparatus using microwave energy in accordance with the conventional art.
Figure 2:
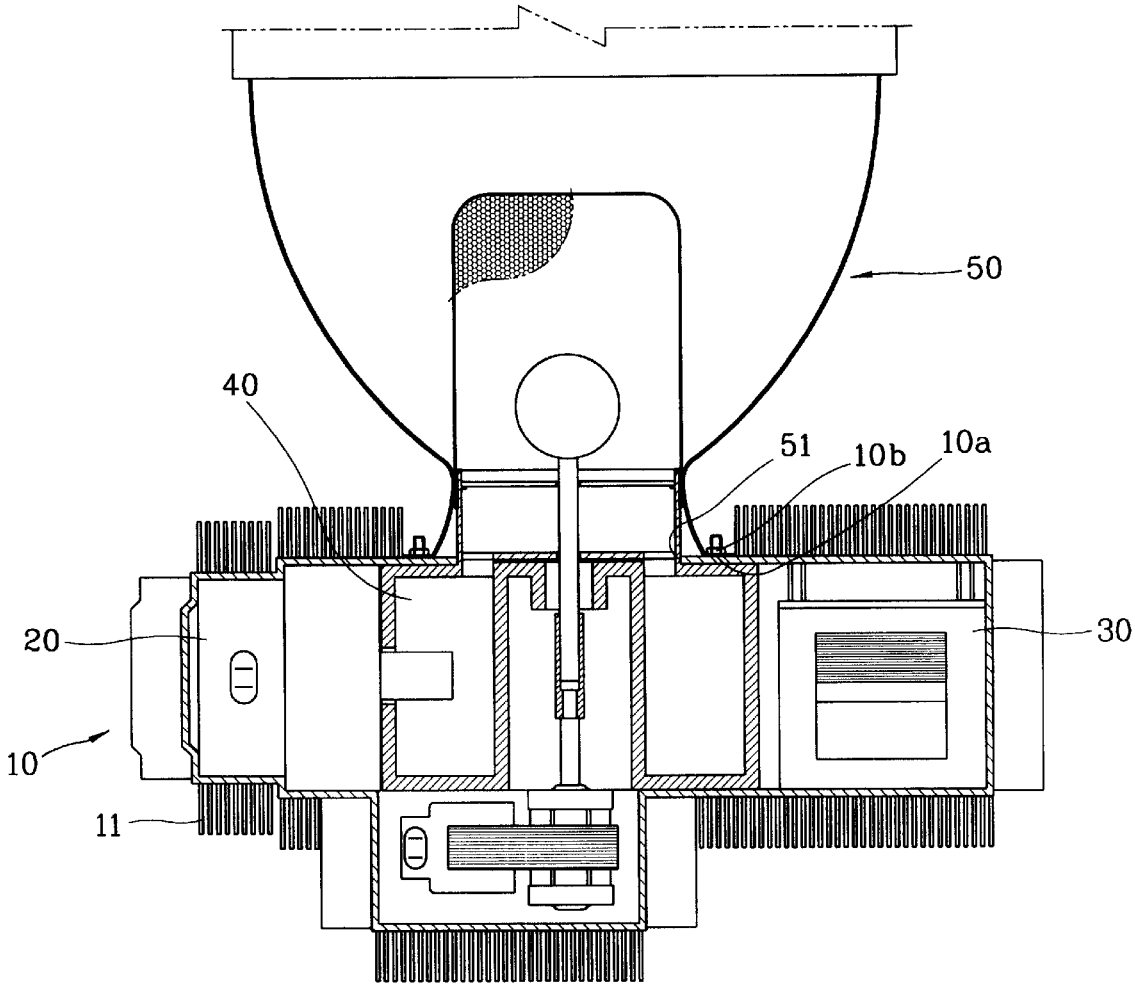
FIG. 2 is a sectional view illustrating a lighting apparatus using microwave energy in accordance with the present invention.
Figure 3:
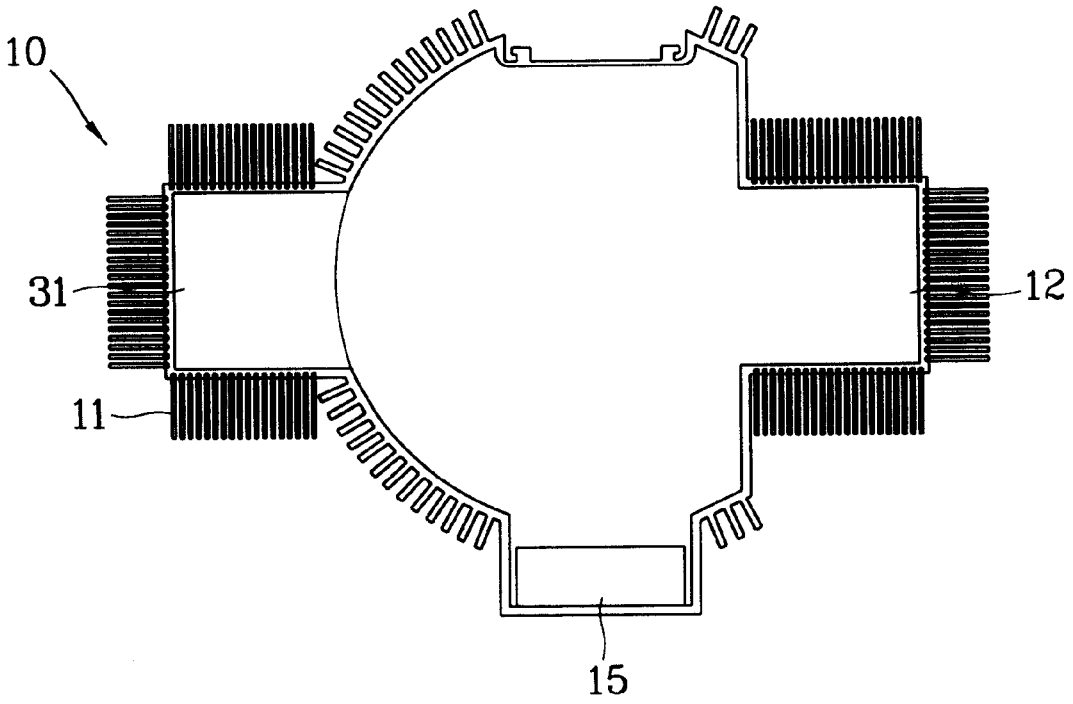
FIG. 3 is a sectional view illustrating a casing of the lighting apparatus using microwave energy in accordance with the present invention.

FIG. 2 is a sectional view illustrating a lighting apparatus using microwave energy in accordance with the present invention, and FIG. 3 is a sectional view illustrating a casing of the lighting apparatus using microwave energy in accordance with the present invention.

As depicted in FIG. 2, a lighting apparatus using microwave energy in accordance with the present invention includes a magnetron 20 generating microwave energy, a bulb 50 generating a light by the microwave energy, a wave guide 40 transmitting the microwave energy generated in the magnetron 20 to the bulb 50 by connecting them, and a casing 10 housing the magnetron 20 and the wave guide 40 and combined with the bulb 40.

As depicted in FIG. 2, the casing 10 is constructed as a heat sink emitting heat generated inside to outside.

Particularly, among internal units of the lighting apparatus, the magnetron 20 and the high voltage generator 30 generate lots of heat, and the wave guide 40 and a condenser generate heat also.

Accordingly, in the casing 10, heat generating unit receiving portions 31, 12 are formed so as to contact tightly to the internal heat generating units and receive them, and a plurality of pins are formed at the external surface in order to emit heat generated in the internal heat generating units outside of the casing.

Particularly, an external wall of the magnetron, the high voltage generator, etc. can be formed as one body with the casing.

A magnetron receiving portion 12 is formed so as to contact tightly to the external surface of the magnetron 20 in order to emit heat generated in the magnetron 20. It is preferable to form the external wall of the magnetron 20 and the casing 10 as one body.

In addition, as depicted in FIG. 3, in order to make the magnetron 20 generate microwave energy, the high voltage generator 30 for applying high voltage power is separately received or received together inside the casing 10, and the high voltage generator receiving portion 31 is formed so as to contact tightly to the external surface of the high voltage generator 30 in order to emit heat generated in the high voltage generator 30 to outside of the casing 10. It is preferable to form the external wall of the high voltage generator 30 and the casing 10 as one body.

Next, as depicted in FIG. 2, an opening portion is formed at the casing 10 in order to combine with a front bulb portion 50, and the casing 10 is sealed-combined with the front bulb portion 50 by a fastening means 10*b* installed at an outer circumference 10*a* of the opening portion 51.

In addition, a plurality of radiating pins 11 are formed at the outer surface of the casing 10 in order to perform heat exchange with external air. Herein, in order to emit heat efficiently, a great number of radiating pins having longer length are formed at the internal heat generating units such as the magnetron 20 and the high voltage generator 30, etc.

In addition, a plurality of pins (not shown) can be formed at other internal portions of the casing 10 in order to perform heat exchange inside the casing 10 more efficiently, and the internal heat generating units such as the magnetron 20 and the high voltage generator 30, etc. can be more efficiently cooled by forming an air flow by installing a fan 15 at the internal surface of the casing 10.

In addition, by installing a cooling fan (not shown) additionally at the exterior of the casing 10 in order to generate an air flow around the radiating pin 11, heat can be emitted more efficiently.

As described above, because a lighting apparatus using microwave energy in accordance with the present invention has a sealed structure, it is possible to prevent impurities from penetrating into a casing, accordingly it can be used at outdoors and its life-span can be extended by preventing damage of internal construction parts.

In addition, by improving a cooling efficiency, it is possible to increase its capacity and decrease its size.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A lighting apparatus using microwave energy, comprising:

a magnetron for generating microwave energy;

a bulb for generating a light by the microwave energy;

a wave guide for connecting the magnetron and the bulb and transmitting the microwave energy generated in the magnetron to the bulb; and a casing housing the magnetron and the wave guide and combining with the bulb;

wherein the casing housing the magnetron is tightly contacted to the exterior of the magnetron in order to emit heat generated in the magnetron.

2. The apparatus of claim 1, further comprising:

a high voltage generator placed inside the casing and applying high voltage power in order to make the magnetron generate microwave energy.

3. The apparatus according to claim 2, wherein a plurality of radiating pins are formed at the exterior of the casing in order to radiate heat.

4. The apparatus of claim 2, wherein the casing houses the high voltage generator so as to contact tightly to the exterior of the high voltage generator in order to emit heat generated in the high voltage generator.

5. The apparatus according to claim 4, wherein a plurality of radiating pins are formed at the exterior of the casing in order to radiate heat.

6. The apparatus according to of claim 1, wherein a plurality of radiating pins are formed at the exterior of the casing in order to radiate heat.

7. The apparatus of claim 1, wherein a fan is installed inside the casing in order to generate a flow of air.

8. The apparatus of claim 1, wherein the casing is sealed in order to prevent impurities from penetrating into.

9. The apparatus of claim 1, wherein a fan is installed at the exterior of the casing in order to generate a flow of air around the radiating pins.

10. The apparatus of claim 1, wherein a plurality of pins are formed at the internal surface of the casing.

11. The apparatus according to claim 1, wherein a fan is installed inside the casing in order to generate a flow of air.

12. A lighting apparatus using microwave energy, comprising:

a magnetron for generating microwave energy;

a bulb for generating a light by the microwave energy;

a wave guide for connecting the magnetron and the bulb and transmitting the microwave energy generated in the magnetron to the bulb; and a casing housing the magnetron and the wave guide and combining with the bulb;

wherein the casing and the external surface of the magnetron are formed as one body in order to emit heat generated in the magnetron.

13. A lighting apparatus using microwave energy, comprising:

a magnetron for generating microwave energy;

a bulb for generating a light by the microwave energy;

a wave guide for connecting the magnetron and the bulb and transmitting the microwave energy generated in the magnetron to the bulb; and a casing housing the magnetron and the wave guide and combining with the bulb;

wherein the casing is constructed as a heat sink and tightly contacted to the exterior of the magnetron in order to emit heat generated in the magnetron.

14. A lighting apparatus using microwave energy, comprising:

a magnetron for generating microwave energy;

a bulb for generating a light by the microwave energy;

a wave guide for connecting the magnetron and the bulb and transmitting the microwave energy generated in the magnetron to the bulb; and a casing housing the magnetron and the wave guide and combining with the bulb;

wherein the casing includes a heat generating unit receiving portion for receiving an internal heat generating unit of the lighting apparatus and is tightly contacted to the exterior of the heat generating unit in order to emit heat generated in the internal heat generating unit.

* * * * *